United States Patent [19]

Cook

[11] 4,443,268

[45] Apr. 17, 1984

[54] PROCESS FOR REMOVING COPPER AND COPPER OXIDE ENCRUSTATIONS FROM FERROUS SURFACES

[75] Inventor: Thomas G. Cook, Burlington County, N.J.

[73] Assignee: The Dow Chemical Company, Midland, Mich.

[21] Appl. No.: 320,815

[22] Filed: Nov. 12, 1981

[51] Int. Cl.[3] ..... C23G 1/08; C23G 1/20

[52] U.S. Cl. ..... 134/2; 134/3; 134/28; 134/29; 134/41

[58] Field of Search ..... 134/2, 3, 29, 28, 41

[56] References Cited

U.S. PATENT DOCUMENTS 3,413,160 11/1968 Teumac ..... 134/2 X 3,438,811 4/1969 Harriman et al. ..... 134/2

*Primary Examiner*—Marc L. Caroff

[57] ABSTRACT

Aqueous alkaline solutions containing ferric chelates of alkylenepolyamine polycarboxylic acids (e.g. EDTA) have been used to remove plated copper from freshly cleaned ferrous metal surfaces. Normally, an oxidant is added during the copper removal stage to oxidize ferrous ion to the ferric state. This process is improved by adding aqueous hydrogen peroxide to the flowing cleaning solution at a rate such that the solution EMF (platinum or iron versus a saturated calomel electrode), as measured at about 80° F. and at a solution pH of about 9.2, becomes more positive than −250 mV in about one hour.

12 Claims, No Drawings

PROCESS FOR REMOVING COPPER AND COPPER OXIDE ENCRUSTATIONS FROM FERROUS SURFACES

BACKGROUND OF THE INVENTION

1. Field of the Invention

This invention pertains to an improved process for removing copper and copper oxide-containing encrustations from ferrous metal surfaces. The invention is particularly applicable in the industrial cleaning of steam generating equipment which contains copper or copper alloys as component parts.

2. Description of the Prior Art

U.S. Pat. No. 3,072,502 (Alfano) describes a method of cleaning steam generating equipment with citric acid. This process is a two step process. The first step is conducted at an acidic pH to remove iron oxide scale and the second step of the process is conducted at an alkaline pH to remove copper. An oxidizing agent is said to be beneficial in the alkaline step. Air introduced by a sparger was illustrated as an embodiment.

U.S. Pat. No. 3,248,269 (Bell) described the use of neutral ammonium citrate at a high temperature and pressure to remove magnetic iron oxides and copper oxides from metal surfaces. The ammonium citrate thermally decomposes to form ammonia in situ. Air, oxygen, or other oxidizing agents were alleged to be helpful in the removal of copper. E.g. air introduced by way of a sparger.

U.S. Pat. No. 3,308,065 and U.S. Pat. No. Re. 30,796 (Lesinski) described a method of removing iron oxide scale from ferrous metal surfaces using aminated or ammoniated chelants at a pH of from about 8 to about 11. As an example of the chelants, Lesinski mentioned ethylenediaminetetraacetic acid (EDTA) and hydroxyethylethylenediaminetriacetic acid (HEDTA) Lesinski taught that the clean metal surface was passivated when the cleaning solution was drained away, exposed to air, and then flushed with fresh water.

U.S. Pat. No. 3,413,160 (Teumac) taught that ferrous metal surfaces cleaned with alkaline chelant solutions were passivated by introducing an oxidizing agent (e.g. air) into the solution while monitoring the oxidation potential. Passivation was said to occur when the oxidation potential was in the range of −250 to −175 millivolts (mV). Corrosion was said to occur if the oxidation step was carried too far. Accuracy and assurance of avoiding corrosion were increased by adding the oxidizing agent slowly enough for prompt reaction and prompt indication of the state of the solution, as shown by the oxidation potential. Column 3, line 69–73 and column 5, lines 60 et seq.

U.S. Pat. No. 3,438,811 and U.S. Pat. No. Re. 30,714 (Harriman) described a method of removing copper and copper oxide encrustations from a ferrous metal surface. The solvent used comprised an aqueous solution of a ferric chelant (e.g. ferric EDTA) at an alkaline pH. Harriman taught that as the copper dissolution proceeded, it was necessary to add an oxidizing agent to the cleaning solution to oxidize ferrous ion to ferric ion. Harriman taught that a variety of oxidizing agents could be used, including hydrogen peroxide, but that air was preferred. The examples illustrated this by showing air sparged into the system continuously during the copper removing process.

The Lesinski, Teumac and Harriman references represent the state of the art as far as industrial cleaning of steam generating equipment is concerned. A commercial process has been developed based upon these patents in which ammoniated EDTA salts at an alkaline pH have been used to clean iron oxide-containing scale from steam generating equipment, then if copper has been plated onto the freshly cleaned iron surface, it is removed by merely introducing an oxidizing agent (e.g. air) into the system in controlled amounts to thereby remove the copper. Thus, the same solvent is used throughout the entire procedure and the iron EDTA chelate is a solvent for the plated copper when air is introduced in controlled amounts to thereby produce ferric chelate. This cleaning technique also leaves the clean metal surface passive and it is an excellent cleaning process, but it can be somewhat extended from a time standpoint. For example, the "air blow down" can take several hours.

SUMMARY OF THE INVENTION

The process for removing copper and copper oxide-containing encrustations from ferrous metal surfaces by contacting the surface with an aqueous alkaline cleaning solution containing ferric chelates of an alkyleneopolyamine polyacetic acid in amounts and under conditions sufficient to dissolve said copper and copper oxide-containing encrustations is improved by adding aqueous hydrogen peroxide to the cleaning solution at a rate such that the solution electromotive force (platinum versus a saturated calomel electrode), as measured at about 80° F. becomes more positive than about −250 millivolts in less than about one hour.

The rapid addition of hydrogen peroxide to the aqueous alkaline cleaning solution results in an excellent cleaning rate for the removal of copper and copper oxide-containing encrustations from the ferrous metal surface and leaves the freshly cleaned surface in a passive state.

Harriman, cited above, is the only reference which teaches that hydrogen peroxide is a suitable oxidant for use in the copper removing step of cleaning. Harriman does not reveal the advantage of adding hydrogen peroxide to the cleaning solution in a manner such as we have discovered. When hydrogen peroxide is employed according to the present invention, novel and unexpected results are achieved in the rate of copper dissolution and degree of passivation. When the techniques of the present invention are not utilized, the rate of copper removal is substantially lower and corrosive attack on the clean ferrous metal surface will result.

DETAILED DESCRIPTION OF THE INVENTION

Harriman described the basic cleaning process and the solvents useful therein. The aqueous cleaning solution comprises a ferric chelate of an alkylenepolyamine polyacetic acid chelating agent alone or together with free polycarboxylic acid chelating agent at an alkaline pH. The pH range is from 7 to about 10, but normally is about 9 to about 9.2 when the solution is buffered with ammonia or a hydroxyalkylamine (e.g. an ethanolamine).

The chelating agents used in the solvent are ferric chelates of alkylenepolyamine polyacetic acids, which Harriman broadly refers to as polycarboxylic acid chelating agents. Usually, these chelating agents are used in the cleaning process not as the free acids per se but as an amine or ammonium salt thereof. The preferred chelants are ethylenediaminetetraacetic acid (EDTA) and N-hydroxyethylethylenediaminetriacetic acid and ammoniated salts thereof. EDTA and ammoniated salts thereof are most preferred.

As Harriman indicated, it is not required that pure ferric and/or ferrous chelates of such polycarboxylic acids be used. In fact, a commercially viable iron chelate solution can be prepared from the "waste" which is generated when an iron oxide-containing scale is dissolved from a ferrous surface by use of an aqueous solvent comprising the polycarboxylic acid chelating agents at an alkaline pH. As the polycarboxylic acid containing solvent dissolves the iron oxide-containing scale, the ferric and/or ferrous chelant is formed in situ. The cleaning process normally takes place at an elevated temperature, for example from about 140° to about 180° F. The degree or percent "spentness" of the iron chelating agent in the cleaning solution is defined by Harriman in column 3. As noted above, it is not necessary for the iron chelating polycarboxylic acid to be completely "spent" for use in the copper removing step. Normally, however, the degree of spentness is desirably quite high.

Hydrogen peroxide is then added to the ferric and/or ferrous chelant containing solution at the end of the iron oxide scale removal step. The aqueous hydrogen peroxide is normally pumped into the flowing cleaning solution in a manner such that the solution, electromotive force (platinum or iron versus a saturated calomel electrode SCE), as measured at about 80° F. and at a solution pH of about 9.2, becomes more positive than −250 millivolts in about one hour. The amount of hydrogen peroxide required is estimated from the pounds of iron in solution. Normally it is desirable to use about a 20 percent mole excess of hydrogen peroxide, based on the moles of iron. If a commercial 35 percent hydrogen peroxide solution is used, this means that about 1.12 pounds of aqueous hydrogen peroxide solution will be added for each pound of iron in solution. The use of the electromotive force method described by Teumac and measurement of the ferric/ferrous iron ratios will permit one skilled in the art to safely and efficiently remove copper and copper oxide-containing encrustations from the metal surface and to passivate the clean metal surface in substantially reduced time periods without significant additional corrosion to the metal article being cleaned.

The following examples will further illustrate the invention:

EXAMPLE 1

A forced circulation power boiler was cleaned by circulating a total of 52,000 pounds of a 40 percent, by weight, tetraammonium EDTA solution at a pH of from about 9.5 to about 9.8 at 280° F. for about 12 hours. The cleaning solution also contained 0.2 percent (by volume) of a commercial corrosion inhibitor (Dowell A224). At the end of the twelve hour cleaning period, the amount of iron oxide in solution was determined by conventional analytical techniques. It was determined that the cleaning solution contained 0.9 weight percent iron (2,100 pounds of iron) and the chelant solution was 83 percent spent. The temperature of the cleaning solution was lowered to 150° F., and 35 percent aqueous hydrogen peroxide was then introduced into the flowing cleaning solution. Initially, the solution electromotive force, EMF, (platinum versus SCE) measured on a cool sample was −605 milivolts (mV). After 45 minutes, about 250 gallons (2344 pounds) of the hydrogen peroxide solution had been introduced at an average rate of about 5.6 gallons per minute and the EMF was −238 mV. At this point, it was determined that 257 pounds of copper was present in the cleaning solution as chelated copper. The copper determination was by atomic absorption spectroscopy. The iron concentration was still 0.90 percent, indicating that the copper removal stage had been accomplished without corrosion to the base metal surfaces. The steam generating unit was circulated for another hour and 100 gallons of additional aqueous hydrogen peroxide was added; neither the copper or iron concentration changed, however, as a result of this.

EXAMPLE 2

A 37,500 gallon steam boiler was cleaned to remove iron oxide scale by circulating 53,000 pounds of an inhibited 40 percent ammoniated EDTA solution, at a pH of about 9.5 to about 9.8 for 22 hours at 275°-300° F. At the end of this cleaning step, the solution contained 0.70 weight percent dissolved iron and the chelant solution was 82 percent spent. When the temperature was lowered to about 180° F., 371 gallons of 35 percent aqeuous hydrogen peroxide was injected into the flowing cleaning solution at an average rate of about 14.8 gallons per minute. The initial EMF of −560 mV rose to −170 mV during the 25 minutes of injection. About 350 pounds of copper was in solution immediately following the injection of the hydrogen peroxide. The cleaning solution was circulated through the boiler for another 4 hours without subsequent hydrogen peroxide addition. At the conclusion of the cleaning process, 531 pounds of copper was in solution and the iron concentration was still about 0.70 weight percent, indicating the boiler was passive and the surface was not corroded by the copper removal process.

COMPARATIVE EXPERIMENT

A forced circulation boiler holding 60,700 gallons of fluid was cleaned to remove iron oxide scale by circulating about 100,000 pounds of an inhibited 40 percent ammoniated EDTA cleaning solution at 288° F. for about 20 hours. At the end of the iron oxide removal stage, 0.52 weight percent iron was in solution and the chelant was 80 percent spent. When the temperature of the cleaning solution dropped to 150° F. an aqueous 35 percent hydrogen peroxide was introduced into the flowing cleaning solution at an average rate of approximately 1.3 gallons per minute. The EMF during the following 10 hours rose from −463 mV to −313 mV. About 25 pounds of copper was removed but the iron concentration increased from 0.52 percent to 0.80 percent, indicating that 1,515 pounds of iron was corroded from the cleaned boiler surface. In this process, the hydrogen peroxide was injected slowly and continuously during the copper removal step. This slow continuous addition of hydrogen peroxide resulted in substantial corrosion of the boiler.

Contrast this result with the results from Example 1 and 2 in which the aqueous hydrogen peroxide was added quickly while continuously monitoring the EMF to assure that it would be more positive than −250 mV in about one hour or less.

What is claimed is:

1. In the process for removing copper and copper oxide-containing encrustations from ferrous metal surfaces by contacting the surfaces with an aqueous alkaline cleaning solution containing a ferric chelate(s) of an alkylenepolyamine polyacetic acid and/or soluble chelating aminated or ammoniated salt(s) thereof in amounts and under conditions sufficient to dissolve said copper and copper oxide-containing encrustations, the improvement comprising adding aqueous hydrogen peroxide to said cleaning solution at a rate such that the solution electromotive force, as measured at about 80° F. (platinum vs. a saturated calomel electrode), becomes more positive than about −250 millivolts in less than about one hour.

2. The process defined by claim 1 wherein said aqueous hydrogen peroxide is about 35 weight percent solution of $H_2O_2$ in water.

3. The process defined by claims 1 or 2 wherein said alkylenepolyamine polyacetic acid is ethylenediaminetetraacetic acid (EDTA) and/or an ammoniated salt thereof.

4. The process defined by claim 1 wherein the pH of said cleaning solution is from about 7 to about 10.

5. The process defined by claim 4 wherein the pH of said cleaning solution is from about 9.0 to about 9.2.

6. The process defined by claim 1 wherein the temperature of said cleaning solution is from about 140° to about 180° F.

7. The process defined by claim 1 wherein said cleaning solution is the "waste" produced by dissolving an iron oxide containing scale from a ferrous metal surface using an aqueous alkaline solution containing an alkylenepolyamine polyacetic acid and/or a soluble chelating aminated or ammoniated salt(s) thereof.

8. A process for cleaning and passivating a ferrous metal surface comprising the steps of:

(a) dissolving iron oxide-containing encrustations from said ferrous metal surface by contacting said surface with an aqueous alkaline cleaning solution containing an alkylenepolyamine polyacetic acid and/or a soluble chelating aminated or ammoniated salt(s) thereof in amounts and under conditions sufficient to dissolve said iron oxide-containing encrustations and thereby produce an aqueous waste solution containing ferric and/or ferrous chelate of said alkylenepolyamine polyacetic acid and/or said salts thereof, and thereafter;

(b) dissolving copper from the ferrous metal surface by adding aqueous hydrogen peroxide to said aqueous waste solution at a rate such that the solution electromotive force, as measured at about 80° F. (platinum vs. a saturated calomel electrode), becomes more positive than about −250 millivolts in less than about one hour.

9. The process defined by claim 8 wherein said alkylenepolyamine polyacetic acid is ethylenediaminetetraacetic acid and/or an ammoniated salt thereof.

10. The process defined by claim 1 wherein said alkylenepolyamine polyacetic acid is ethylenediaminetetraacetic acid, N-hydroxyethylethylenediaminetriacetic acid, and/or ammoniated salts thereof.

11. The process defined by claim 7 wherein said alkylenepolyamine polyacetic acid is ethylenediaminetetraacetic acid, N-hydroxyethylethylenediaminetriacetic acid, and/or ammoniated salts thereof.

12. The process defined by claim 8 wherein said alkylenepolyamine polyacetic acid is ethylenediaminetetraacetic acid, N-hydroxyethylethylenediaminetriacetic acid, and/or ammoniated salts thereof.

* * * * *